US005101904A

United States Patent [19]

Gilbert

[11] Patent Number: 5,101,904

[45] Date of Patent: Apr. 7, 1992

[54] DOWNHOLE TOOL ACTUATOR

[76] Inventor: Bruce Gilbert, 1300 11th St., Ste. 500, Huntsville, Tex. 77340

[21] Appl. No.: 670,234

[22] Filed: Mar. 15, 1991

[51] Int. Cl.[5] ..... E21B 34/10

[52] U.S. Cl. ..... 166/319; 166/264; 166/332; 166/374

[58] Field of Search ..... 166/374, 373, 284, 332, 166/319, 120, 212

[56] References Cited

U.S. PATENT DOCUMENTS 4,044,829 8/1977 Jessup ..... 166/374

4,422,506 12/1983 Beck ..... 166/374 X

*Primary Examiner*—Stephen J. Novosad

*Attorney, Agent, or Firm*—James E. Bradley

[57] ABSTRACT

An actuator for actuating a downhole mechanism in a well utilizes increased annular pressure in one instance, and a control line pressure in a second instance. The actuator has an actuating chamber in which an actuating piston moves. The actuating piston communicates with the annulus pressure on one side and with pressure in an intensified pressure chamber on the other side. A control valve locates in a control passage leading from the intensified pressure chamber to the actuator piston. A vent valve locates in a vent passage that leads from the actuator piston to the annulus. The vent valve will close when pressure in the intensified pressure chamber exceeds the annulus pressure by a selected amount. Then, at a selected higher pressure, the control valve will open, allowing the pressure in the intensified pressure chamber to act on the actuator piston. A differential area piston will supply the increased pressure in the intensified pressure chamber from the annulus when the actuator is used with a test tool. When used with the safety valve, a control line may lead from the surface to the intensified pressure chamber if an unlimited number of cycles are required.

22 Claims, 7 Drawing Sheets

DOWNHOLE TOOL ACTUATOR

BACKGROUND OF THE INVENTION

1. Field of the Invention

This invention relates in general to oil and gas well downhole equipment, and in particular to an actuator that is remotely actuated by fluid pressure applied from the surface.

2. Description of the Prior Art

In an oil and gas well, at times, a downhole mechanism must be remotely actuated. For example, a test tool may be lowered on tubing and located in the vicinity of a formation for which testing is desired. The formation is isolated from the well annulus by setting a packer between the tubing and the well bore or casing. A valve in the test tool must be opened to allow fluid to flow from the formation being tested into the tubing. This is handled in various ways.

In one technique, an actuator will be incorporated with the test tool. The actuator has an actuating element that moves the valve in the test tool. The actuating element will be moved by increasing the annulus pressure surrounding the tubing and the actuator. This is handled by applying pressure at the surface, with the annulus being filled with fluid.

While this is workable, improvements are desirable. For example, the tool must be sized so that the annulus pressure due to hydrostatic force does not actuate the tool while being run to operating depth. Also, these tools normally utilize closed chambers filled with fluid. Increasing temperatures encountered as the tool descends into the well will cause the volume of the fluid to expand. To avoid premature actuation, this must be accounted for, making the equipment complex.

In another instance, safety valves will be located downhole in producing wells. A safety valve will be located in the production tubing. It has a spring that urges the valve to a closed position. An actuator will be connected to a control line that extends through the annulus to the surface. The operator applies hydraulic pressure to the control line to cause the actuator to move the valve against the spring to the open position.

While this type of safety valve is workable, large springs must be used so as to prevent the hydrostatic pressure in the control line from causing the safety valve to open. Consequently, the depth to which the safety valve may be run is limited by the size of the spring which can be incorporated in the tool. The safety valve protects against damage causing loss of pressure in the control line running from the valve to the surface. If the well head is blown away during a storm, the control line would be broken and pressure would be lost (except for hydrostatic) and the valve would close, thus preventing uncontrolled flow. Thus the greater the depth, the greater the protection.

SUMMARY OF THE INVENTION

The actuator of this invention in one embodiment uses the application of increased annulus pressure to actuate a downhole test tool. This actuator has a housing with an actuating chamber. An actuating element is carried in the housing connected with an actuator piston. The actuator piston reciprocates in the actuating chamber.

The housing also has an intensified pressure chamber. Means are employed to provide fluid pressure in this intensified pressure chamber that is greater than the annulus pressure. In one embodiment, this consists of a differential piston which utilizes annulus pressure and increases it due to differential pressure areas. In another embodiment, the intensified pressure chamber will be connected to a control line extends to the surface for the application of pressure.

A control passage leads from the intensified pressure chamber to the actuator piston. A vent passage leads from the actuating pressure section to the annulus. A vent valve locates in the vent passage. The vent valve will normally be open. It will close when pressure in the intensified pressure chamber increases over the annulus pressure by a selected amount.

A control valve will be located in the control passage. It is normally closed. It will open only when the vent valve is closed, and furthermore only when the pressure in the intensified pressure chamber exceeds the annulus pressure by a set amount.

DETAILED DESCRIPTION OF THE INVENTION

Figure 1A:
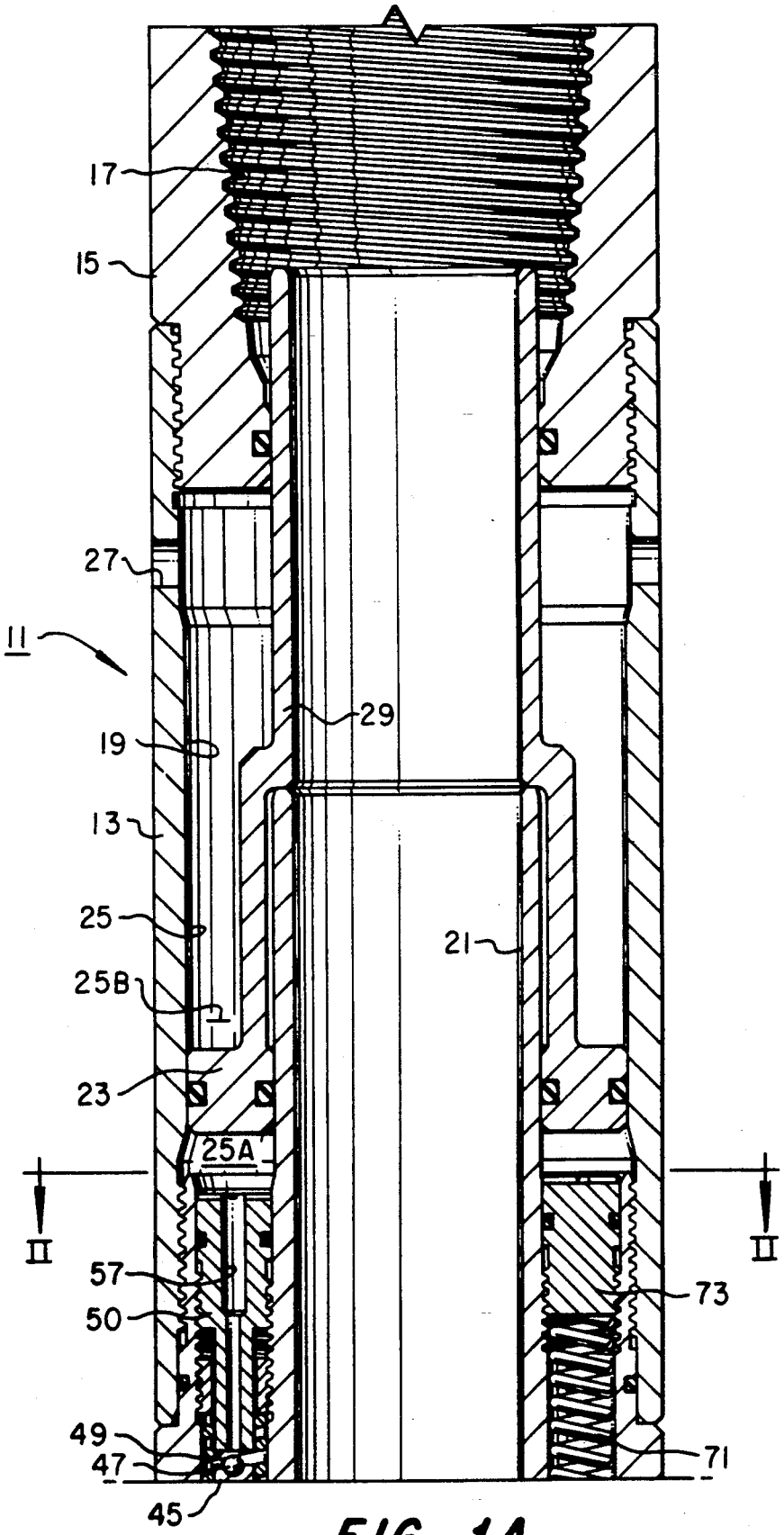
FIGS. 1A and B are a vertical sectional view illustrating an actuator constructed in accordance with this invention for use with a test tool.

Referring to FIG. 1A, the actuator 11 has a tubular housing 13. An adapter 15 locates at the upper end of the housing 13. The adapter 15 has threads 17 for connecting to a downhole mechanism, such as a test tool run-in on conduit. A bore 19 extends through the housing 13. A concentric tube 21 mounts within the housing 13 and forms a part of housing 13.

A piston 23 will reciprocally locate in the annular space between the tube 21 and the housing 13. This annular space may be considered an actuating chamber 25. The space below the piston 23 will be considered to be the actuating pressure section 25A. Annulus pressure section 25B will consist of the space in the actuating chamber 25 above piston 23. A port 27 leads through the housing 13 from the annulus pressure section 25B to the exterior of the housing 13. The exterior of the housing 13 will be located in the well, which will contain a liquid. An actuator element 29 will be integrally formed to the upper side of piston 23 and extend upward therefrom into the adapter 15. The actuator element 29 is a tubular member which will engage a valve or the like in the downhole tool (not shown).

Figure 1B:
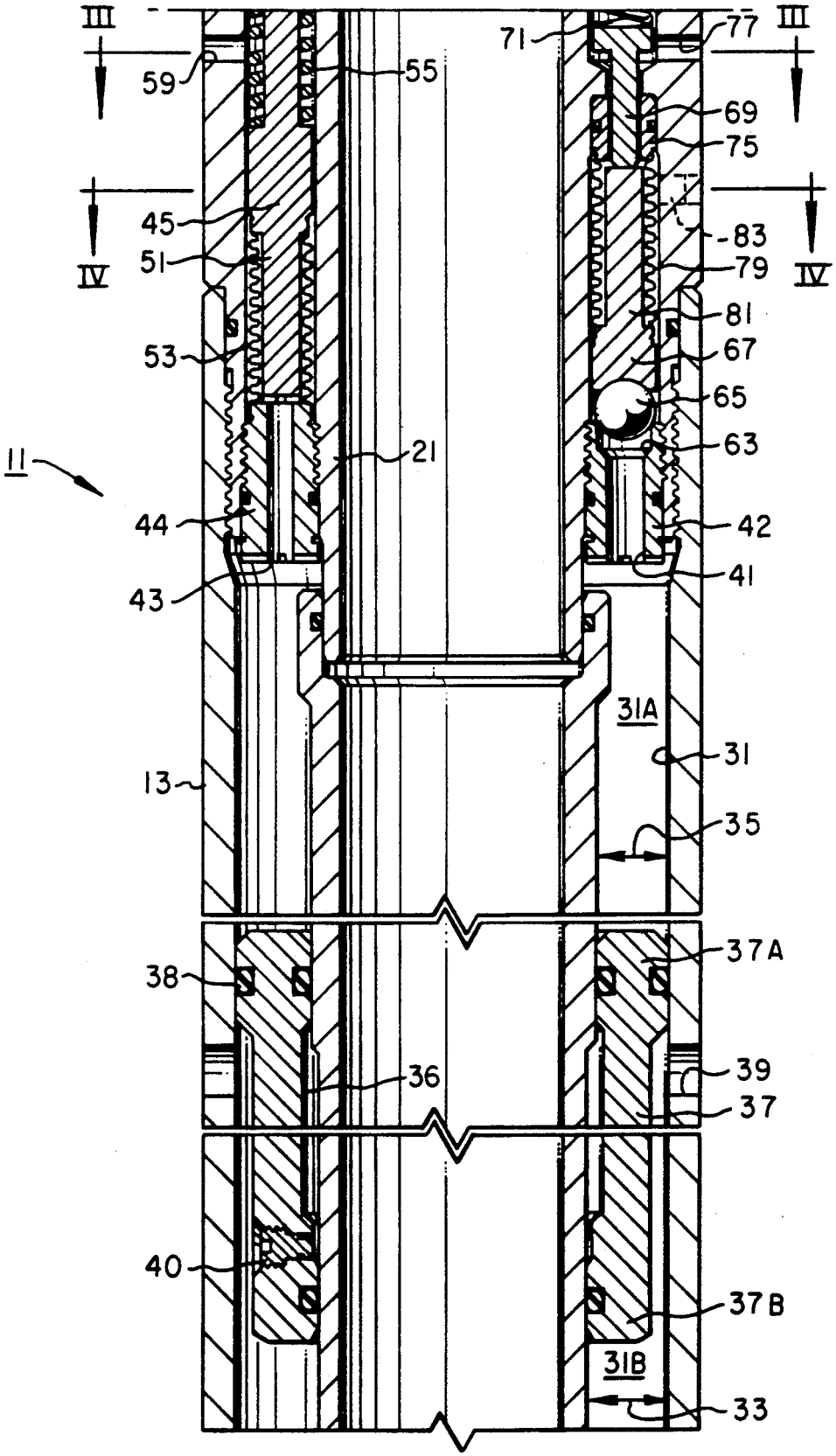
Figure 2:
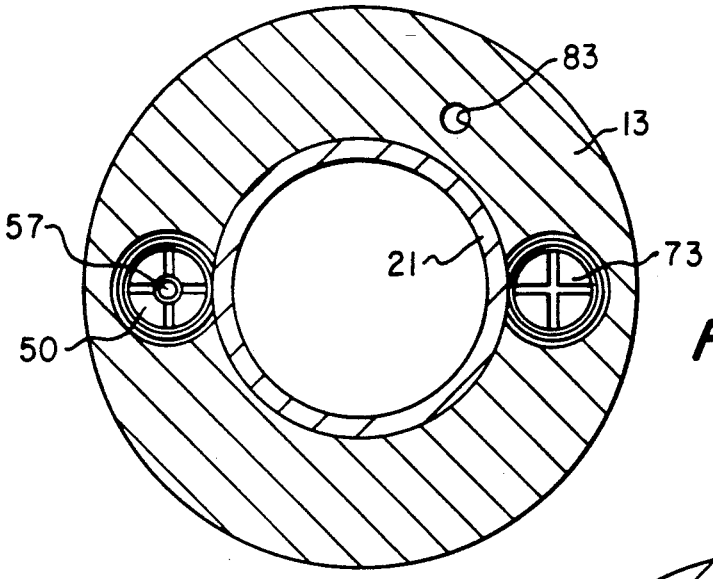
FIG. 2 is a cross sectional view of the actuator of FIGS. 1A and 1B, taken along the line II—II of FIG. 1A.
Figure 3:
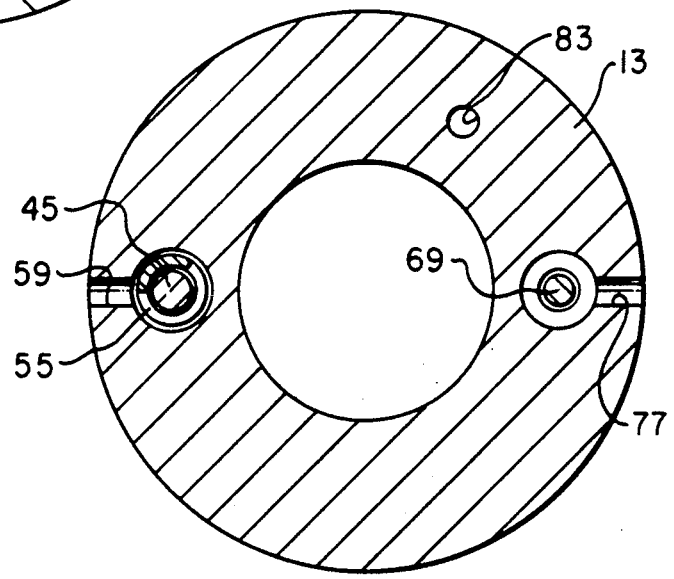
FIG. 3 is a cross sectional view of the actuator of FIGS. 1A and B, taken along the line III—III of FIG. 1B.

Referring to FIG. 1B, an intensifier cavity 31 locates in an lower portion of the housing 13. Intensifier cavity 31 has an upper portion and a lower portion. The pressure area 35 of the upper portion is smaller than the pressure area 33 of the lower portion.

A differential area piston 37 moves within the intensifier cavity 31. The differential area piston 37 has an upper piston 37A. Piston 37A locates in the upper portion of cavity 31. Lower piston 37B locates in the lower portion of cavity 31. Piston 37B seals on its outer diameter by incorporating a portion of the upper piston 37A. A recess 36 is located on the inner diameter of differential area piston 37, between inner diameter seals 38 of piston 37A and piston 37B. This recess area 36 is either evacuated initially, or left at atmospheric pressure. There will be no liquid in the recess 36. The seals 38 will cause the recess 36 to remain at the evacuated or atmospheric pressure when the actuator is in the well. A plug 40 enables bleed off of any liquid trapped in recess 36 between the upper and lower inner diameter seals 38 of piston 37 during assembly.

Lower piston 37B has a greater pressure area than upper piston 37A. The portion of the cavity 31 above piston 37A will be referred to as intensified pressure chamber 31A. The portion of cavity 31 below the piston 37B will be referred to as annulus chamber 31B.

An annulus port 39 extends from the annulus surrounding the housing 13 into the annulus chamber 31B. The differential area piston 37 is shown in a lower position in FIG. 1B. Because of the smaller pressure area 35, the pressure within the intensified pressure chamber 31A above the smaller piston 37A will be at a higher level than the pressure in the annulus chamber 31B below the smaller piston 37A. In one embodiment selected to operate at hydrostatic pressures between 3000 psi and 4000 psi, the different pressure areas 33, 35 are selected so that pressure in the intensified chamber 31A will be 108 percent of the pressure in the annulus chamber 31B.

The intensified pressure chamber 31A has a control outlet port 41 which is located in a threaded member 42 secured directly above the intensified pressure chamber 31A. The intensified pressure chamber 31A has a vent actuating port 43 located within a threaded member 44 secured directly above the intensified pressure chamber 31A. The threaded members 42, 44 are small cylindrical members, not annular rings concentric with the longitudinal axis of the housing 13.

A vent valve 45 locates directly above the threaded member 44. Vent valve 45 has a ball element 47 on its upper end, as shown in FIG. 1A. The ball element 47 will engage a vent seat 49 on the lower end of a threaded member 50 when the vent valve 45 is in a closed position. Normally the vent valve 45 will be in an open position as shown in FIG. 1A. Vent valve 45 has an intensified pressure end 51 located on its lower end. The intensified pressure end 51 communicates with intensified pressure in intensified pressure chamber 31A through the vent actuating port 43. The intensified pressure end 51 has a considerably greater pressure area than the pressure area of vent seat 49.

A bellows 53 surrounds the intensified pressure end 51 and secures to the threaded member 44. This keeps the fluid from the intensified pressure chamber 31A within the bellows 53 but allows the vent valve 45 to move up and down. The intensified pressure end 51 of vent valve 45 is an adapter for bellows 53, to weldably close the bellows 53 and seal the ends against external pressure. A spring 55 urges the vent valve 45 down to the open position shown. Spring 55 has a spring force selected to keep the vent valve 45 open unless the pressure in the intensified pressure chamber 31A exceeds the annulus pressure by a selected amount.

Figure 5A:
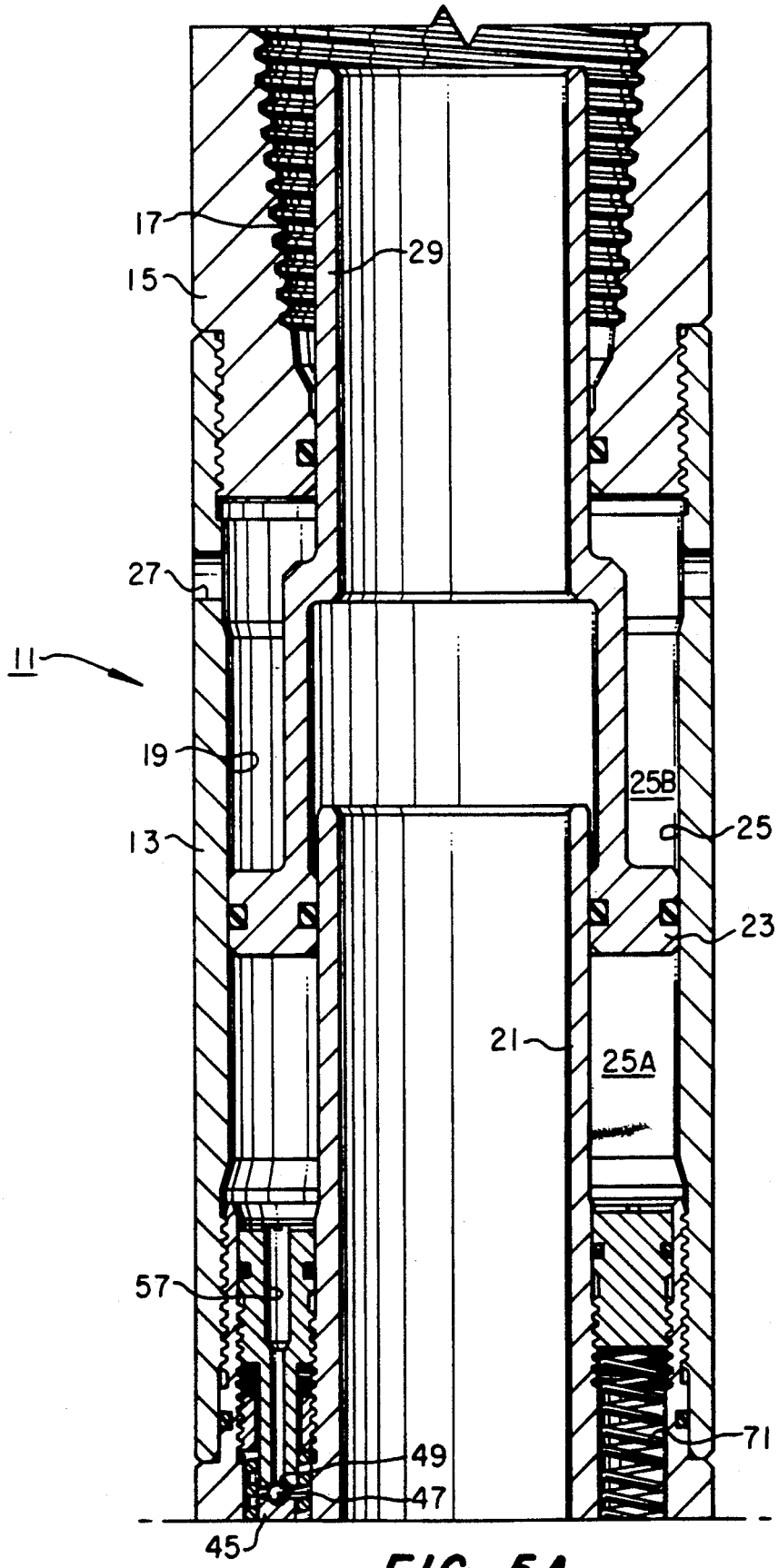
FIGS. 5A and 5B are a vertical cross sectional view of the actuator of FIGS. 1A and 1B, but showing the actuator in an actuating position.

Referring to FIG. 1A, a vent passage 57 extends through threaded member 50 from the vent seat 49 upward to the actuating pressure section 25A. The vent passage 57 will communicate with an annulus port 59, shown in FIG. 1B, which leads to the annulus. When the vent valve 45 closes as shown in FIG. 5A, the fluid within the actuating pressure section 25A will not vent through the annulus port 59.

Referring to FIG. 1B, the control outlet port 41 leads through threaded member 42 to a control seat 63 on the upper end of threaded member 42. A control ball element 65 of a control valve 67 will engage the control seat 63. A plunger 69 extends upward from the upper end of the control valve 67 to a coil spring 71.

As shown in FIG. 1A, a plug 73 located in the housing 13 reacts against the coil spring 71. Referring to FIG. 1B, a bushing 75 encircles the plunger 69. Bushing 75 does not sealingly engage the plunger 69, thus will allow fluid to flow from an annulus port 77 downward into contact with the control valve 67. Control valve 67 has an annulus pressure end 81 that communicates with the annulus pressure from the annulus port 77. Bellows 79 join the annulus pressure end 81 to contain the annulus fluid, and separate it from fluid of the intensified pressure chamber 31A. The annulus pressure end 81 of control valve 67 is an adapter for bellows 79, to weldably close the metal bellows 79 and seal the ends against external pressure.

Figure 4:
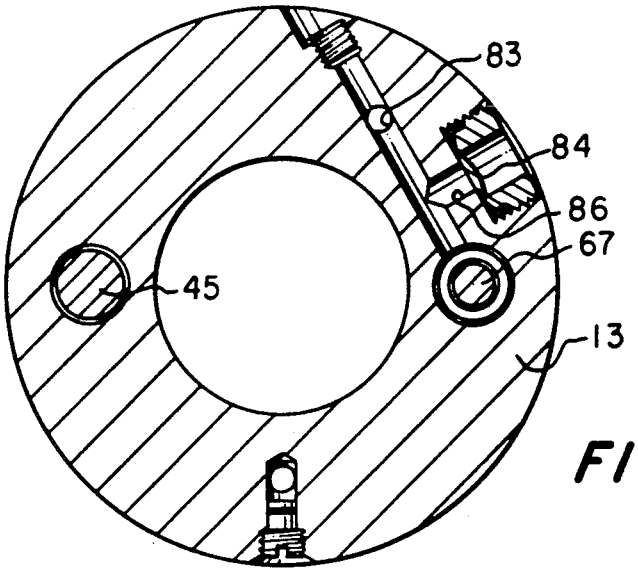
FIG. 4 is a cross sectional view of the actuator of FIGS. 1A and 1B, taken along the line IV—IV of FIG. 1B.

As shown also in FIG. 4, a control passage 83 extends from a point above the control seat 63 and below bushing 75 upward to the actuating pressure section 25A of the actuating chamber 25. A rupture disk 84 is located in a port 86 that leads from the control passage 83 to the exterior of housing 13. If the annulus pressure exceeds the allowable limit, the intensified pressure in the control passage 83 will also exceed an allowable limit and rupture the rupture disk 84. This disables the actuator 11 and closes the valve in the test tool, thus serving as a pressure relief means.

Figure 5B:
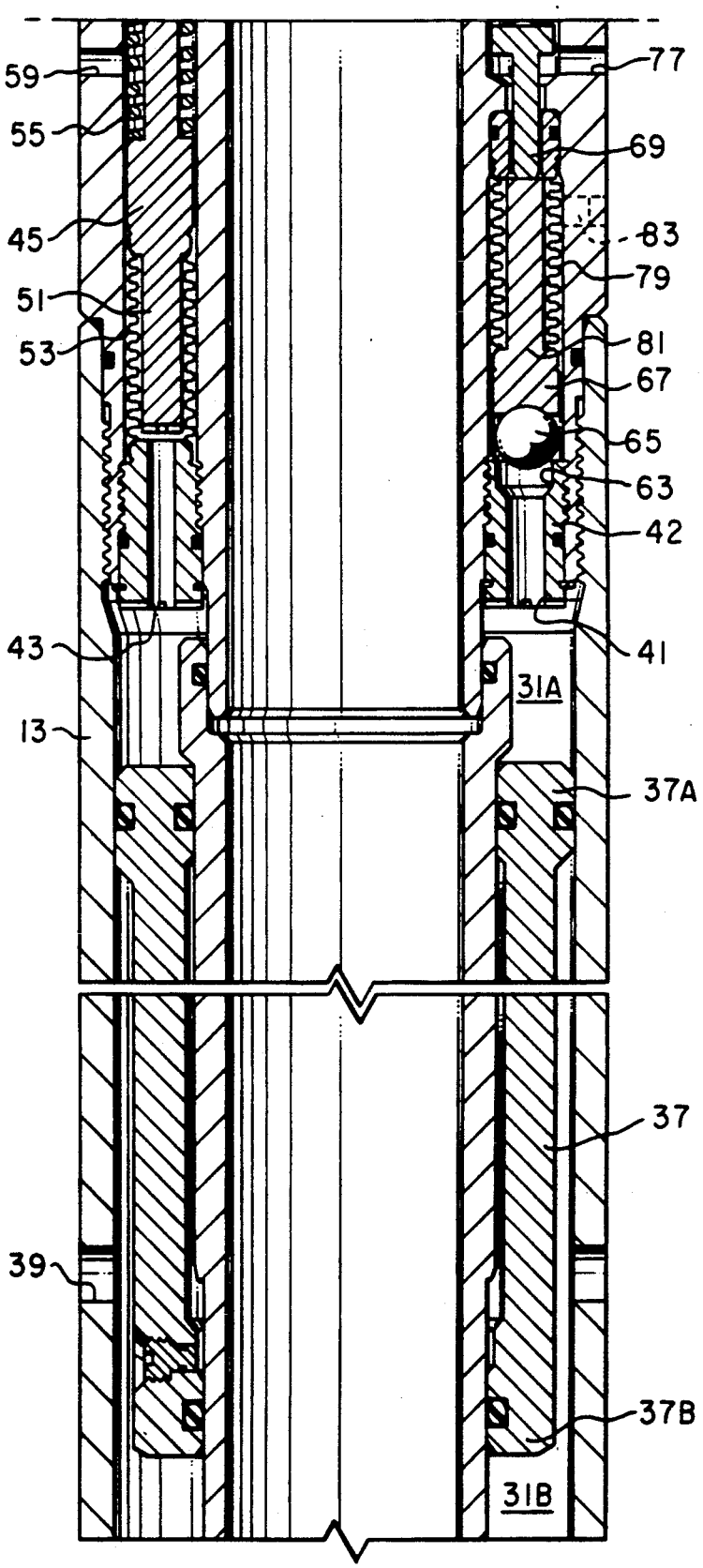

The bellows 79 and the seal around the exterior of the bushing 75 prevent fluid from the intensified pressure chamber 31A from flowing upward past bushing 75. Fluid from the intensified pressure chamber 31A will communicate with the actuating pressure section 25A through the control passage 83 when the control valve 67 is in the open position, as shown in FIG. 5B.

In operation, the intensified pressure cavity 31A is filled with oil or another liquid prior to use. The actuator 11 will be secured to the lower end of a test tool and lowered on conduit into a well. The annulus of the well surrounding the housing 13 will be filled with a fluid. As it descends into the well and when it reaches its proper depth, the actuator 11 will appear as shown in FIGS. 1A and 1B.

The hydrostatic pressure from the weight of the fluid in the well will be located on both sides of the actuator piston 23. Well annulus fluid will also be present at hydrostatic pressure in the vent passage 57, because the vent valve 45 will be in the open position. Well fluid at hydrostatic pressure will thus also be in the control passage 83 from the actuating pressure section 25A down to the control seat 63. Annulus fluid at hydrostatic pressure will exist in the annulus chamber 31B below the upper piston 37A.

Because of the differential areas of the pistons 37A and 37B, the pressure in the intensified pressure chamber 31A will be greater than the hydrostatic pressure by the difference in the pressure areas 31A and 31B. This difference is about eight percent. Consequently at 2,000 PSI hydrostatic pressure, the pressure in the intensified pressure chamber 31A will be 2,160 PSI. The force due to the pressure in the intensified pressure chamber 31A acts on the control valve element 65, tending to push it upward. This upward force is resisted by the force of the spring 71 (FIG. 1A) and the force due to the annulus fluid acting on the annulus pressure end 81 of the control valve 67.

The force of spring 71 will be sized so that a selected differential pressure must be reached before the control valve 67 will move upward from the control seat 63. For example, the specifications may require a spring that exerts enough force to overcome 300 PSI difference between the pressure in the intensified pressure chamber 31A and the annulus pressure.

Similarly, the pressure in the intensified pressure chamber 31A acts on the intensified pressure end 51 of the vent valve 45. It tends to close the vent valve 45. This closure will be resisted by the vent spring 55 and the force due to the hydrostatic pressure acting on the vent valve 45. The force in the spring 55 will be selected so as to cause vent valve 45 to close at a selected differential. This differential will be less than the differential required to open the control valve 67. Consequently, the spring force or stiffness of the spring 55 will be adjusted to be less by a selected amount than the spring force of spring 71.

When at the selected depth, the operator will close a valve at the surface and begin applying pressure to increase the pressure in the annulus. The differential area piston 37 will tend to move upward. When the pressure in the annulus reaches a high enough amount to create enough differential between intensified pressure chamber 31A and the annulus pressure, then the vent valve 45 will close the vent seat 49. This closure prevents fluid in the actuating pressure section 25A from venting to annulus pressure.

Then as the annulus pressure continues to increase, the control valve 67 will open. Pressure at the level of the pressure in the intensified pressure chamber 31A will communicate to the actuating pressure section 25A. This pressure cannot force the vent valve 45 back open even though the fluid pressure on both sides of vent valve 45 will be the same. The vent valve 45 will not open because the much smaller cross-sectional area of the vent seat 49 relative to the vent valve intensified pressure end 51. The closing force is a result of the difference in the pressure areas of vent seat 49 and pressure end 51. This closing force will be greater than the force tending to open the vent valve 45, which will be due to spring 55.

The pressure in the actuating section 25A will cause the actuator piston 23 to move upward because the opposite side of the actuator piston 23 will be at annulus pressure. A portion of the fluid in the intensified pressure chamber 31A will pass into the control passage 83 and thus communicate with the annulus fluid in the annulus pressure section 25A. The differential area piston 37 moves upward also when the actuator piston 23 moves upward, to maintain the increased pressure in the actuating section 25A, which increases in volume as the actuator piston 23 moves upward. The actuating position is shown in FIGS. 5A and 5B. The upward movement of actuator element 29 will cause the test tool valve to open to make the test.

While the actuator 11 is lowered into the well, the temperature will increase. Also, the temperature will increase when the well is opened to flow and while injecting treating fluid from the surface. These temperature changes will not affect operation of the actuator. Any liquid expansion in the intensified pressure chamber 31A due to temperature increase while running into the well can be accommodated by slight downward movement of the differential area piston 37. There will be no liquid expansion problem due to temperature increase of the recess 36 because it contains air, not liquid.

When the operator wishes to close the test tool, he lowers the pressure in the annulus. When the annulus pressure drops down so that the pressure difference is less than what is needed to keep the control valve 67 open, spring 71 will then move control valve 67 back to the closed position. When the annulus pressure drops further so that the pressure difference is less than what is needed to keep the vent valve 45 closed, then the spring 55 will cause the vent valve 45 to open. This will vent the pressure in the actuating pressure section 25A to the annulus, permitting the test tool to close. The test tool tester valve (not shown) is closed by force from a heavy return spring, such as one having 3000 pounds force. The actuator 11 will then appear as shown in FIGS. 1A and 1B.

A portion of the fluid originally placed in the intensified pressure chamber 31A will be vented to the annulus when closing because a portion of this fluid passed into the actuating pressure section 25A when the control valve 67 opened during opening actuation. The differential area piston 37 will not move back downward upon closing of the test tool valve. Enough fluid will be placed in the intensified pressure chamber 31A before use to allow several cycles.

Figure 6A:
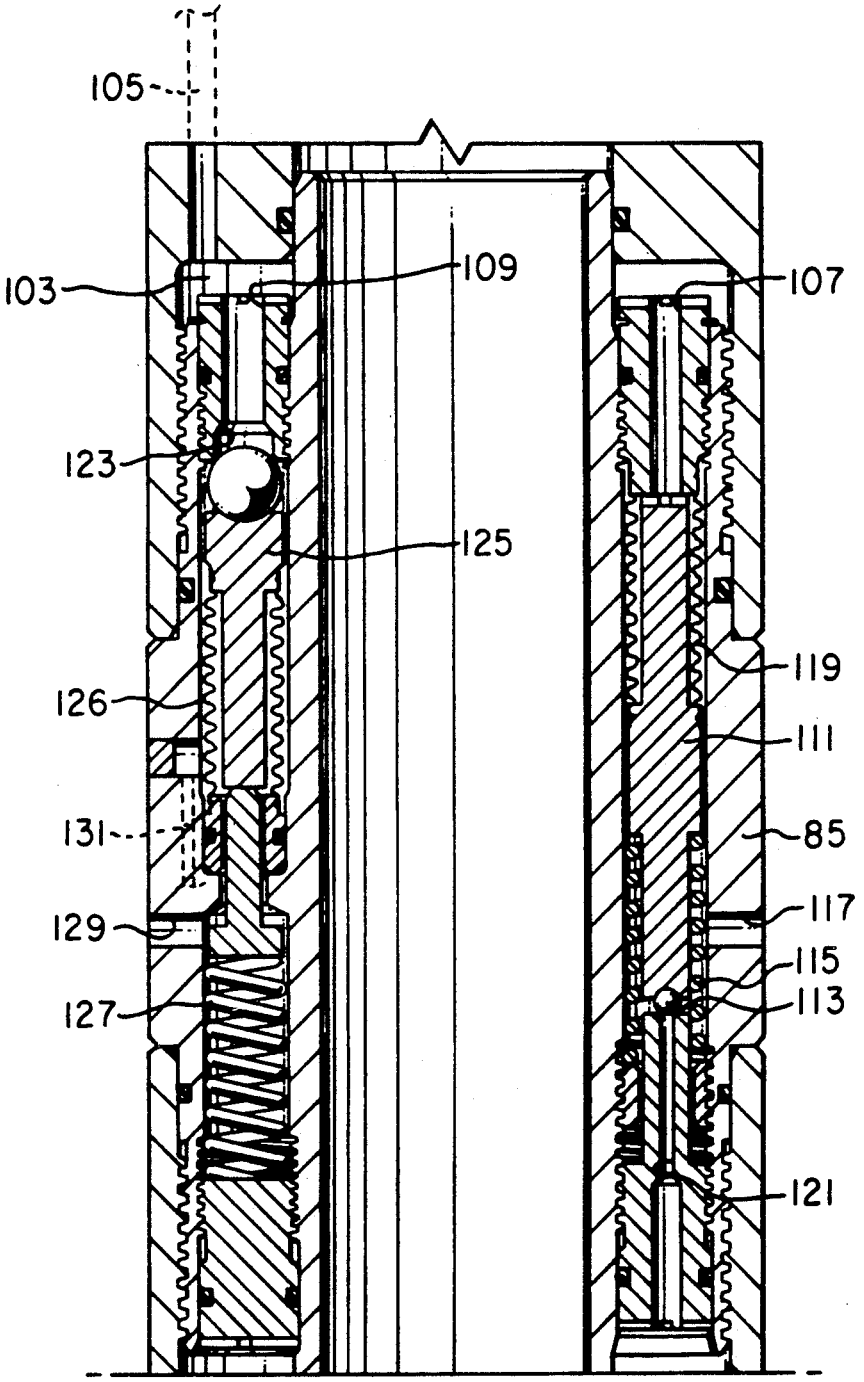
FIGS. 6A and 6B are a vertical cross sectional view of an alternate embodiment of an actuator, particularly for use with a safety valve.
Figure 6B:
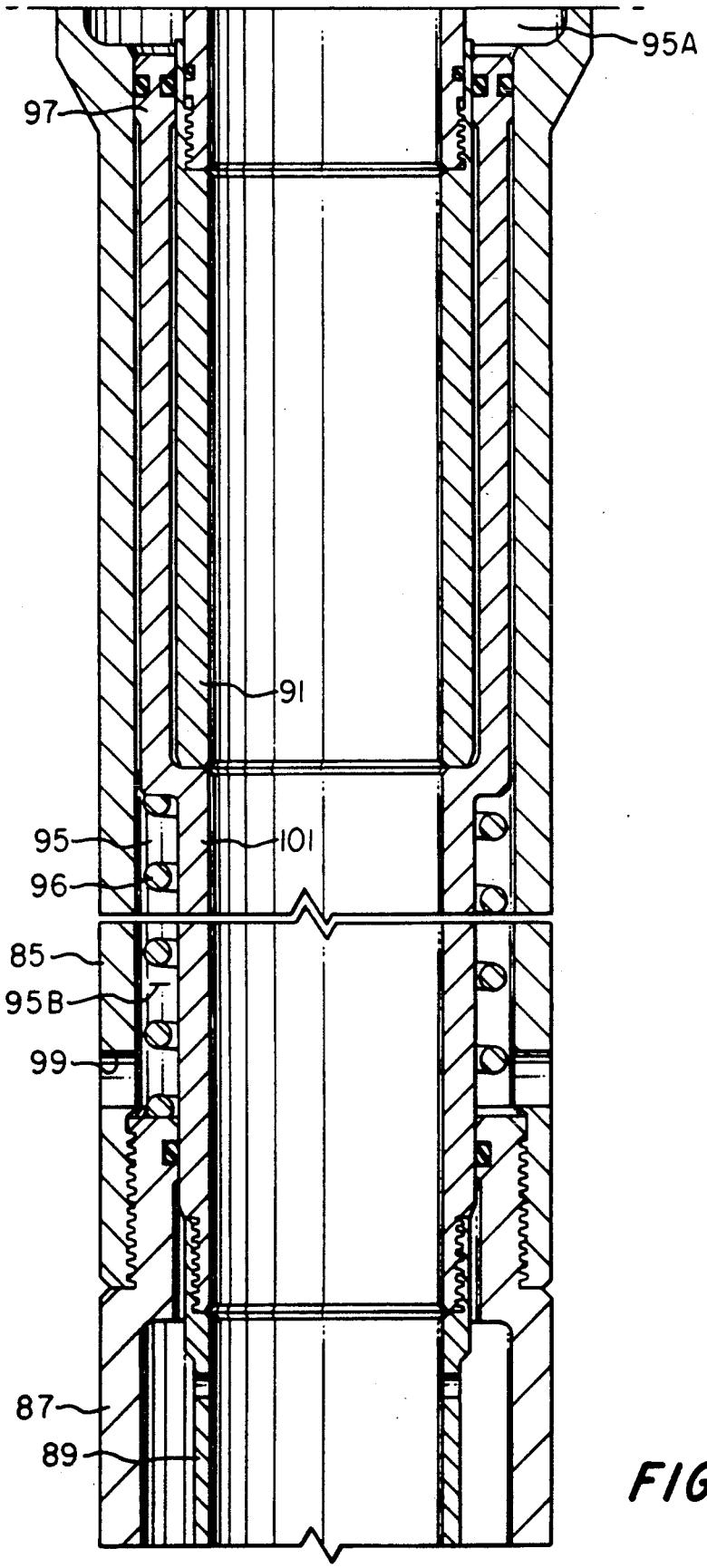

Referring to FIGS. 6A and 6B, an alternate embodiment is shown for use with a safety valve. In this embodiment, the actuator has a housing 85 that secures to the upper end of the valve body 87. The valve body 87 is part of the safety valve and has a valve opening prong 89. A tube 91 extends co-axially through and becomes part of the housing 85. Tube 91 defines between its exterior and the housing 85 an actuating chamber 95. An actuating pressure section 95A locates above the actuating piston 97. An annulus pressure section 95B locates below the actuating piston 97.

A light safety valve return spring 96 is compressed between a shoulder of valve body 87 and a shoulder on piston 97. Spring 96 has only enough force to overcome friction. An annulus port 99 communicates annulus fluid to the annulus pressure section 95B. An actuating element 101 extends downward from the actuator piston 97 and engages the valve opening prong 89.

Housing 85 has an intensified pressure chamber 103, shown in FIG. 6A. The intensified pressure chamber 103 connects to a control line 105. Control line 105 is a small diameter conduit that extends through the annulus to the surface for receiving pressurized fluid. The intensified pressure chamber 103 has a vent bellows outlet 107 and a control outlet 109.

A vent valve 111 locates below the vent belows outlet 107. Vent valve 111 engages a vent seat 113 when the vent valve 111 is closed. A spring 115 urges the vent valve 111 to the open position. An annulus port 117 communicates with the vent seat 113. A bellows 119 extends from the vent valve 111 to the member which has the vent bellows outlet 107. A vent passage 121 leads from the actuating pressure section 95A to the vent seat 113.

A control seat 123 is located at the control port 109. Control seat 123 is normally closed by control valve 125. A coil spring 127 urges the control valve 125 to the closed position. An annulus port 129 communicates annulus fluid to the control valve 125 within a bellows 126. A coil spring 127 urges the control valve 125 to the closed position. A control passage 131 extends downward from the exterior of the bellows 126 to the actuating pressure section 95A.

In the operation of the embodiment of FIGS. 6A and B, when the actuator is installed in the well, control pressure will be applied to the control line 105. This pressure acts on the control valve 125 at the control seat 123. Downward movement of the control valve 125 will be resisted by the annulus hydrostatic pressure acting on the control valve 125 within the bellows 126. Coil spring 127 will also exert a force acting against the pressure in the intensified pressure chamber 103.

Similarly, the intensified pressure in the intensified pressure chamber 103 will tend to push the vent valve 111 to the closed position. This will be resisted by the hydrostatic force acting on the vent valve 111 and by the coil spring 115.

When the actuating pressure 103 reaches a high enough level above the annulus pressure, the vent valve 111 will close. Subsequently, the pressure will force the control valve 125 to the open position. Fluid will flow through the control passage 131 to the actuating pressure section 95A. This forces the piston 97 downward to open the safety valve. The intensified pressure located in the actuating pressure section 95A will not open the vent valve 111, because of the much smaller cross-sectional area of the vent seat 113 relative to the pressure area acting within the bellows 119.

If the pressure in the control line 105 drops to hydrostatic due to damage from a storm or otherwise, then the control valve 125 will close and the vent valve 111 will open. The higher pressure in the actuating pressure section 95A will vent to the annulus, permitting the safety valve return spring 96 to withdraw the prong 89, thus closing the valve to shut-in the well.

The invention has significant advantages. The first embodiment works well with a test tool in that it does not have sealed chambers within it containing a hydraulic fluid. Consequently, temperature increase of the actuator a it is lowered into the well will not have any effect on the actuation of the device. In regard to the second embodiment, the device works well for a safety valve, because it requires only a differential pressure between the hydrostatic and the actuating pressure to cause the valve to actuate. It does not need to overcome the hydrostatic force of fluid within a control line, and no spring is required for this purpose. The only spring is a small return spring with a force only sufficient to overcome friction. The actuator allows the use of lower pressure in the control line, thus reducing the cost.

While the invention has been shown in only two of its forms, it should be apparent to those skilled in the art that it is not so limited, but is susceptible to various changes without departing from the scope of the invention.

I claim:

1. An actuator for actuating a downhole mechanism in response to application of pressure applied from the surface, comprising in combination:

a housing having a longitudinal axis, the housing adapted to be placed in a well in engagement with the downhole mechanism and surrounded by an annulus containing a fluid which is under an annulus pressure;

an actuating chamber located in the housing, having an annulus port in communication with pressure in the annulus;

an actuator element carried in the housing, the actuator element being adapted to engage the downhole mechanism and being movable axially between an actuating position and a release position;

actuator piston means mounted to the actuator element and carried in the actuating chamber for axial movement, dividing the actuating chamber into an annulus pressure section which communicates with the annulus port and an actuating pressure section;

an intensified pressure chamber in the housing;

intensifying means for supplying to the intensified pressure chamber an intensified pressure greater than the annulus pressure;

control passage means leading from the intensified pressure chamber to the actuating pressure section of the actuating chamber;

vent passage means leading from the actuating pressure section to the annulus;

vent valve means located in the vent passage means and in communication with pressure in the intensified pressure chamber for venting the actuating pressure section to the annulus and for closing the actuating pressure section from the annulus only when the pressure in the intensified pressure chamber exceeds the annulus pressure by a selected value; and control valve means located in the control passage means for opening the control passage means to allow pressure to be communicated from the intensified pressure chamber to the actuating pressure section only when the pressure in the intensified pressure chamber exceeds the pressure in the annulus by a selected value and only when the vent valve means is closed, to cause the actuator piston means to move the actuator element from the release position to the actuating position.

2. The apparatus according to claim 1 wherein the control valve means comprises:

a seat in the control passage means;

a control valve carried in the control passage means and movable between a normally closed position in engagement with the seat and an open position spaced from the seat, the control valve having an annulus pressure end opposite the end of the control valve which contacts the seat;

spring means for urging the control valve toward engagement with the seat; and means for communicating annulus pressure to the annulus pressure end of the control valve, whereby the control valve will move to the open position only when the force exerted by the pressure in the intensified pressure chamber exceeds the combined force resulting from the spring means and the annulus pressure.

3. The actuator according to claim 1 wherein the vent valve means comprises:

a seat in the vent passage means;

a vent valve carried in the vent passage means and movable between a normally open position spaced from the seat and a closed position in engagement with the seat and blocking annulus pressure from the vent passage means, the vent valve having an intensified pressure end opposite the end of the vent valve which contacts the seat:

spring means for urging the vent valve toward the open position; and means for communicating pressure from the intensified pressure chamber to the intensified pressure end of the vent valve to urge the vent valve to move toward the closed position, whereby the vent valve will move to the closed position only when the force exerted by the pressure in the intensified pressure chamber exceeds the combined force resulting from the spring means and the annulus pressure.

4. The actuator according to claim 1 wherein the intensifying means comprises a control line extending from the actuator to the surface for receiving pressurized fluid to the intensified pressure chamber.

5. The actuator according to claim 1 wherein the intensifying means comprises:

an intensifier cavity in the housing, comprising the intensified pressure chamber and an annulus chamber which communicates with fluid in the annulus, the intensified pressure chamber having a smaller pressure area than the pressure area of the annulus chamber; and a differential area piston means having piston sections carried in the intensified pressure chamber and annulus chamber of the intensifier cavity, for increasing the pressure of fluid within the intensified pressure chamber to the intensified pressure.

6. The actuator according to claim 5 wherein the piston sections are annular members, each having an inner diameter, the inner diameters being axially separated from each other by a recess, the recess being sealed by the piston sections and free of any liquid so as to avoid liquid expansion in the recess due to temperature increase.

7. The actuator according to claim 1 further comprising:

pressure relief means located in the control passage means for venting pressure to the annulus if the pressure in the control passage means exceeds an allowable limit because of annulus pressure in excess of a selected limit.

8. An actuator for actuating a downhole mechanism in response to application of pressure to a well annulus, comprising in combination:

a housing having a longitudinal axis;

an actuating chamber located in the housing, having an annulus port in communication with pressure in the annulus;

an actuator element carried in the housing, the actuator element being adapted to engage the downhole mechanism and being movable axially between an actuating position and a release position;

actuator piston means mounted to the actuator element and carried in the actuating chamber for axial movement, dividing the actuating chamber into an annulus pressure section which communicates with the annulus port and an actuating pressure section;

an intensifier cavity in the housing, having an intensified pressure chamber and an annulus chamber which has a greater pressure area than the pressure area of the intensified pressure chamber, the annulus chamber having an annulus port in fluid communication with the annulus;

differential area piston means carried in the intensifier cavity, for increasing pressure of fluid within the intensified pressure chamber to a greater value than fluid in the annulus chamber;

control passage means leading from the intensified pressure chamber to the actuating pressure section of the actuating chamber;

vent passage means leading from the actuating pressure section of the actuating chamber to the annulus;

vent valve means located in the vent passage means and in fluid communication with the actuating pressure section of the actuating chamber pressure chamber, for venting the actuating pressure section to the annulus and for closing the actuating pressure section from the annulus only when the pressure in the intensified pressure chamber exceeds the annulus pressure by a selected value; and control valve means located in the control passage means for opening the control passage means to allow pressure to be communicated from the intensified pressure chamber to the actuating pressure section only when the pressure in the intensified pressure chamber exceeds the pressure in the annulus by a selected value and only when the vent valve means is closed, to cause the actuator piston means to move the actuator element from the release position to the actuating position.

9. The actuator according to claim 8 wherein the control valve means comprises:

a seat in the control passage means;

a control valve carried in the control passage means and movable between a normally closed position in engagement with the seat and an open position spaced from the seat, the control valve having an annulus pressure end opposite the end of the control valve which contacts the seat;

spring means for urging the control valve toward engagement with the seat; and means for communicating annulus pressure to the annulus pressure end of the control valve, whereby the control valve will move to the open position only when the force exerted by the pressure in the intensified pressure chamber exceeds the combined force resulting from the spring means and the annulus pressure.

10. The actuator according to claim 8 wherein the vent valve means comprises:

a seat in the vent passage means;

a vent valve carried in the vent passage means and movable between a normally open position spaced from the seat and a closed position in engagement with the seat and blocking pressure in the actuating pressure section of the actuating chamber from the vent passage means, the vent valve having an intensified pressure end opposite the end of the vent valve which contacts the seat;

spring means for urging the vent valve toward the open position; and means for communicating pressure from the intensified pressure chamber to the intensified pressure end of the vent valve to urge the vent valve to move toward the closed position, whereby the vent valve will move to the closed position only when the force exerted by the pressure in the intensified pressure chamber exceeds the combined force resulting from the spring means and the annulus pressure.

11. An actuator for actuating a downhole mechanism in response to application of pressure to a well annulus, comprising in combination:

a housing having a longitudinal axis;

an actuating chamber located in the housing, having an annulus port in communication with the annulus for receiving annulus fluid;

an actuator element carried in the housing, the actuator element being adapted to engage the downhole mechanism and being movable axially between an actuating position and a release position;

actuator piston means mounted to the actuator element and carried in the actuating chamber for axial movement, dividing the actuating chamber into an annulus pressure section which communicates with the annulus port and an actuating pressure section;

an intensifier cavity in the housing, having an intensified pressure chamber and an annulus pressure chamber, the intensified pressure chamber and the annulus chamber each having a pressure area, the pressure area of the annulus pressure chamber being larger than the pressure area of the intensified pressure chamber, the annulus pressure chamber having an annulus port in communication with the annulus for receiving annulus fluid, the intensified pressure chamber having a control outlet port;

a differential area piston carried in the intensified pressure chamber and annulus pressure chamber of the intensifier cavity;

control passage means leading from the control outlet port to the actuating pressure section of the actuating chamber;

vent passage means leading from the actuating pressure section of the actuating chamber to the annulus;

a vent seat in the vent passage means;

a vent valve carried in the vent passage means and movable between a normally open position spaced from the vent seat and a closed position in engagement with the vent seat and blocking the fluid in the actuating pressure section of the actuating chamber from movement through the vent seat, the vent valve having an intensified pressure end opposite the end of the vent valve which contacts the vent seat;

vent spring means for urging the vent valve toward the open position;

means for communicating pressure from the intensified pressure chamber to the intensified pressure end of the vent valve to urge the vent valve to move toward the closed position, whereby the vent valve will move to the closed position only when the force exerted by the pressure in the intensified pressure chamber exceeds the combined force resulting from the vent spring means and the annulus pressure;

a control seat at the control outlet port of the intensified pressure chamber;

a control valve carried in the control passage means and movable between a normally closed position in engagement with the control seat and an open position spaced from the control seat, the control valve having an annulus pressure end opposite the end of the control valve which contacts the control seat;

control spring means for urging the control valve toward engagement with the control seat; and means for communicating annulus pressure to the annulus pressure end of the control valve, whereby the control valve will move to the open position only when the force exerted by the pressure in the intensified pressure chamber exceeds the combined force resulting from the control spring means and the annulus pressure.

12. The actuator according to claim 11 wherein the force exerted by the vent spring means is less than the force exerted by the control spring means, so that the vent valve will move to the closed position at a lower annulus pressure than that required to open the control valve.

13. The actuator according to claim 11 wherein the means for communicating pressure from the intensified pressure chamber to the intensified pressure end of the vent valve comprises a bellows having an interior in communication with the intensified pressure chamber and an end secured to the intensified pressure end of the vent valve.

14. The actuator according to claim 11 wherein the means for communicating pressure from the annulus to the annulus pressure end of the control valve comprises a bellows having one end secured to the annulus pressure end of the control valve and having an interior exposed to annulus fluid.

15. The actuator according to claim 11 wherein the actuating element is a tubular member extending longitudinally through the actuating chamber.

16. The actuator according to claim 11 wherein the vent spring means and the control spring means each comprises a coil spring.

17. An actuator for actuating a downhole mechanism in response to application of pressure applied from the surface, comprising in combination:

a housing having a longitudinal axis, the housing adapted to be placed in a well in engagement with the downhole mechanism and surrounded by an annulus containing a fluid which is under an annulus pressure;

an actuating chamber located in the housing, having an annulus port in communication with pressure in the annulus;

an actuator element carried in the housing, the actuator element being adapted to engage the downhole mechanism and being movable axially between an actuating position and a release position;

actuator piston means mounted to the actuator element and carried in the actuating chamber for axial movement, dividing the actuating chamber into an annulus pressure section which communicates with the annulus port and an actuating pressure section;

an intensified pressure chamber in the housing;

intensifying means, including a control line extending from the actuator through the annulus to the surface, for supplying to the intensified pressure chamber an intensified pressure greater than the annulus pressure;

control passage means leading from the intensified pressure chamber to the actuating pressure section of the actuating chamber;

vent passage means leading from the actuating pressure section to the annulus;

a vent seat in the vent passage means;

a vent valve carried in the vent passage means and movable between a normally open position spaced from the vent seat and a closed position in engagement with the vent seat and blocking pressure in the actuating pressure section of the actuating chamber from the vent passage means, the vent valve having an intensified pressure end opposite the end of the vent valve which contacts the vent seat;

vent spring means for urging the vent valve toward the open position;

means for communicating pressure from the intensified pressure chamber to the intensified pressure end of the vent valve to urge the vent valve to move toward the closed position, whereby the vent valve will move to the closed position only when the force exerted by the pressure in the intensified pressure chamber exceeds the combined force resulting from the vent spring means and the annulus pressure;

a control seat in the control passage means;

a control valve carried in the control passage means and movable between a normally closed position in engagement with the control seat and an open position spaced from the control seat, the control valve having an annulus pressure end opposite the end of the control valve which contacts the control seat;

control spring means for urging the control valve toward engagement with the control seat; and means for communicating annulus pressure to the annulus pressure end of the control valve, whereby the control valve will move to the open position only when the force exerted by the pressure in the intensified pressure chamber exceeds the combined force resulting from the control spring means and the annulus pressure.

18. The actuator according to claim 17 wherein the force exerted by the vent spring means is less than the force exerted by the control spring means, so that the vent valve will move to the closed position at a lower annulus pressure than that required to open the control valve.

19. The actuator according to claim 17 wherein the means for communicating pressure from the vent outlet port of the intensified pressure chamber to the intensified pressure end of the vent valve comprises a bellows having one end secured around the vent outlet port and the other end secured to the intensified pressure end of the vent valve.

20. The actuator according to claim 17 wherein the means for communicating pressure from the annulus to the annulus pressure end of the control valve comprises a bellows having one end secured to the annulus pressure end of the control valve and an interior exposed to annulus fluid.

21. The actuator according to claim 17 wherein the actuating element is a tubular member extending longitudinally through the actuating chamber.

22. The actuator according to claim 17 wherein the vent spring means and the control spring means each comprises a coil spring.

* * * * *